United States Patent [19]

Atsumi et al.

[11] Patent Number: 4,517,811

[45] Date of Patent: May 21, 1985

[54] REFRIGERATING APPARATUS HAVING A GAS INJECTION PATH

[75] Inventors: Akira Atsumi; Kensaku Oguni; Shigeaki Kuroda, all of Shimizu; Takao Senshu, Ibaraki; Kazuo Yoshioka, Shimizu, all of Japan

[73] Assignee: Hitachi, Ltd., Tokyo, Japan

[21] Appl. No.: 548,520

[22] Filed: Nov. 3, 1983

[30] Foreign Application Priority Data

Nov. 6, 1982 [JP] Japan ..... 58-193963

[51] Int. Cl.[3] ..... F25B 41/04

[52] U.S. Cl. ..... 62/197; 62/205; 62/509

[58] Field of Search ..... 62/197, 174, 216, 222, 62/510, 509, 196.2, 205

[56] References Cited

U.S. PATENT DOCUMENTS

| | | | |
|---|---|---|---|
| 933,682 | 9/1909 | Voorhees | 62/197 X |
| 2,720,756 | 10/1955 | Stebbins | 62/197 X |
| 2,914,925 | 12/1959 | Martin | 62/197 |
| 4,014,182 | 3/1977 | Granryd | 62/510 |
| 4,259,848 | 4/1981 | Voigt | 62/197 X |

FOREIGN PATENT DOCUMENTS

| | | |
|---|---|---|
| 104459 | 8/1976 | Japan . |
| 47296 | 11/1980 | Japan . |

*Primary Examiner*—Harry B. Tanner

*Attorney, Agent, or Firm*—Antonelli, Terry & Wands

[57] ABSTRACT

A refrigerating apparatus including a refrigerant circuit constituted by a compressor, a condenser, a first expansion device, a gas-liquid separator, a second expansion device and an evaporator which are successively connected. An injection path interconnects an upper part of the gas-liquid separator and a cylinder of the compressor during the compression stroke thereof. An auxiliary path is formed by connecting a solenoid valve closed in the normal operation and an auxiliary expansion device, with the auxiliary path being provided between the gas-liquid separator and the evaporator so as to be parallel to the second expansion device, and connected to the gas-liquid separator at a position higher than the connecting position of the second expansion device to the gas-liquid separator. The solenoid valve is opened when the load on the refrigerating apparatus increases. A main flow path resistance member may be provided in the injection path, and a further path formed by connecting an injection solenoid valve for injection, open during the normal operation and an auxiliary flow path resistance member together with the further path being connected in parallel to the main flow path resistance member. The injection solenoid valve is closed when the load on the refrigerating apparatus increases.

10 Claims, 3 Drawing Figures

REFRIGERATING APPARATUS HAVING A GAS INJECTION PATH

BACKGROUND OF THE INVENTION

The present invention relates to a refrigerating apparatus for use in an air conditioner or the like and, more particularly, to a refrigerant circuit thereof having a gas injection path.

A typical refrigerant circuit having a gas injection path is formed by connecting a compressor, a condenser, a first expansion device, a gas-liquid separator, a second expansion device and an evaporator successively through piping. In the thus formed refrigerant circuit, a piping is connected to the upper part of the gas-liquid separator, and the other end of the piping is connected and opened to an intermediate portion of a cylinder of the compressor, to form a gas injection path.

A high-pressure gas refrigerant discharged from the compressor flows into the condenser, where the gas refrigerant is cooled by a circulating fluid (air or water) and condensed to become a liquid refrigerant. The liquid refrigerant flowing out of the condenser passes through the first expansion device, where it is reduced to an intermediate pressure to allow a portion of the liquid refrigerant to gasify, and the gas and liquid portions of the refrigerant are separated through the gas-liquid separator. The liquid refrigerant flows out from the bottom part of the gas-liquid separator and passes through the second expansion device, where it is reduced to a predetermined pressure and then flows into the evaporator. In the evaporator, the liquid refrigerant absorbs heat from a circulating fluid (air or water) to evaporate, becoming a gas refrigerant, which returns to the compressor.

On the other hand, the gas refrigerant separated from the liquid refrigerant in the gas-liquid separator and collected in the upper part thereof is passed through the gas injection path and injected into the compressor during the compression stroke thereof.

In the case where a refrigerating apparatus having the above gas injection path is applied to a heat-pump type air conditioner, in the heating operation, the condenser serves as the service-side heat exchanger, while the evaporator serves as the heat source-side heat exchanger.

The refrigerant flowing into the gas-liquid separator through the first expansion device has about 20% to 30% gas refrigerant mixed therein. This gas refrigerant is separated in the gas-liquid separator and is then passed through the gas injection path and injected to the compressor during the compression stroke thereof. Accordingly, the amount of the refrigerant discharged from the compressor is larger, by the amount of the injected gas refrigerant, than that in the case where no gas injection is performed, so that the amount of heat given off in the condenser, i.e., the heating capacity increases.

On the other hand, in the air-cooling operation, the evaporator serves as the service-side heat exchanger, while the condenser serves as the heat source-side heat exchanger.

In the air-cooling operation, before the refrigerant flows into the evaporator, the gas refrigerant has already been separated therefrom in the gas-liquid separator, and only the liquid refrigerant, which is effective for heat exchange, flows into the evaporator. Accordingly, the amount of heat absorbed in the evaporator, i.e., the air-cooling capacity, increases.

As described above, the gas injection system has a refrigerant circuit that increases the heating or air-cooling capacity by injecting the gas refrigerant into the compressor during the compression stroke thereof. However, a conventional apparatus employing the gas injection system has the following problems. Since the gas refrigerant separated in the gas-liquid separator is constantly injected into the compressor during the compression stroke thereof, when the load on the apparatus increases, the discharge pressure and temperature excessively rise to lower the operation efficiency. In addition, the reliability is unfavorably lowered due to the rise in temperature of the electric motor unit incorporated in the compressor.

For overcoming the above-mentioned problems, means have been proposed wherein, in an overload operation such as mentioned above, the injection path is shut off and only the ordinary refrigerant circuit is employed.

In, for example, Japanese Patent Publication No. 47296/1980, a refrigerating apparatus is proposed wherein a stop valve is provided in an intermediate portion of the injection pipe interconnecting the gas-liquid separator and the compressor. The stop valve is open in the normal operation to inject the refrigerant gas, separated, in the gas-liquid separator into the compressor through the injection pipe and is closed, when the apparatus is started or overloaded, to shut off the injection pipe.

In, for example Japanese Utility Model Laid Open No. 104459/1976 a heat-pump type refrigerating apparatus is proposed wherein a stop valve is provided in an intermediate portion of the injection pipe interconnecting the gas-liquid separator and the compressor, and the stop valve is closed to shut off the injection pipe in an overload operation in which the discharge temperature is high or in the heating operation performed when the outside air temperature is high.

Both the of the above art apparatus are arranged such that, in an overload operation, the injection pipe is shut off to prevent the overheating of the compressor.

However, the load on the compressor cannot be reduced in a sufficient manner only by controlling the valve to open or close the gas injection path as in both the above-mentioned prior art apparatus. Moreover, if the injection path is shut off while the pressure reduction effected in the second expansion device is maintained constant, the liquid refrigerant collected in the gas-liquid separator and flowing out to the evaporator may be undesirably drawn into the compressor.

Accordingly, an object of the invention is to provide a refrigerating apparatus having a gas injection path and capable of checking the rise in discharge pressure and temperature by decreasing the amount of the refrigerant circulating through the refrigerant circuit when the load on the refrigerating apparatus increases.

To this end, according to the invention, a refrigerating apparatus comprises: a main refrigerant circuit constituted by a compressor, a condenser, a first expansion device, a gas-liquid separator, a second expansion device and an evaporator which are successively connected through piping, with an injection path interconnecting an upper part of the gas-liquid separator and a cylinder of the compressor during the compression stroke thereof. An auxiliary path is constituted by connecting a solenoid valve, closed in the normal operation, and an auxiliary expansion device, with the auxiliary path being provided between the gas-liquid separator and the evaporator so as to be parallel to the second expansion device. The auxiliary path is connected to the gas-liquid separator at a position higher than the connecting position of the second expansion device to the gas-liquid separator, wherein the solenoid valve is opened when the load on the refrigerating apparatus increases.

In the normal operation, the solenoid valve is closed, so that the refrigerant discharged from the compressor circulates through the main refrigerant circuit. In addition, the gas refrigerant separated in the gas-liquid separator is passed through the injection path and injected into the cylinder of the compressor during the compression stroke thereof. In such a normal operation, the amount of the refrigerant charged into the gas-liquid separator is set so that the level of the liquid refrigerant therein is relatively low.

When the load on the apparatus increases, the solenoid valve is opened. Consequently, the gas-phase part of the gas-liquid separator and the evaporator are allowed to communicate with each other through the auxiliary expansion device. Therefore, the difference in pressure between the gas-phase part and the evaporator decreases to reduce the amount of the liquid refrigerant collected in the gas-liquid separator and flowing out therefrom to the evaporator. As a result, the level of the liquid refrigerant in the gas-liquid separator gradually rises, i.e., the liquid refrigerant stored therein increases in amount, so that the refrigerant circulating through the refrigerant circuit decreases in amount. Accordingly, the refrigerant liquid collected in the condenser decreases in amount to lower the refrigerant supercooling degree at the outlet of the condenser. In addition, since the pressure in the gas-liquid separator lowers, the refrigerant injected into the compressor decreases in flow rate, and the refrigerant discharged from the compressor decreases in flow rate. Therefore, the rise in discharge pressure and temperature is prevented.

Another object of the invention is to provide a refrigerating apparatus capable of holding down the rise in discharge pressure and temperature to a smaller degree in an overload operation by decreasing the amount of the refrigerant circulating through the main refrigerant circuit as well as positively controlling the flow rate of the gas refrigerant to be injected.

To this end, according to the invention, the refrigerating apparatus, in addition to the above mentioned elements comprises a main flow path resistance member for controlling the flow rate provided in an intermediate portion of the injection path, and a path constituted by connecting through piping a solenoid valve for injection which is open in the normal operation and an auxiliary flow path resistance member. The path is connected in parallel to the main flow path resistance member, wherein, when the load on the refrigerating apparatus increases, the solenoid valve for the separator is opened and at the same time, the solenoid valve for injection is closed.

In the normal load condition, the operation of this refrigerating apparatus is similar to that of the first-mentioned refrigerating apparatus, except that the gas refrigerant to be injected into the compressor during the compression stroke thereof through the injection path flows through the main flow path resistance member and the auxiliary flow path resistance member in parallel.

When the load on the refrigerating apparatus is larger than normal, similarly to the first-mentioned refrigerating apparatus, the solenoid valve for the gas-liquid separator is opened to raise the level of the liquid refrigerant in the gas-liquid separator. Consequently, the refrigerant circulating through the refrigerant circuit decreases in amount. In addition, as the pressure in the gas-liquid separator lowers, the gas refrigerant to be injected into the compressor during the compression stroke thereof decreases in flow rate. Moreover, in this apparatus, the solenoid valve for injection is closed, so that the gas refrigerant to be injected flows through only the main flow path resistance member (the auxiliary flow path resistance member is shut off). As a result, the resistance to flow increases, so that the flow rate of the gas refrigerant to be injected is further decreased. Accordingly, the rise in discharge pressure can be held down to a smaller degree.

Thus, according to the invention, the amount of the refrigerant circulating through the refrigerant circuit and the flow rate of the gas refrigerant to be injected are regulated according to the load condition. Therefore, in the normal operation, the capacity and efficiency of the refrigerating apparatus can be increased by the gas injection. Moreover, when the load on the refrigerating apparatus increases, the rise in discharge pressure and temperature and the rise in input of the compressor can be held down to a small degree. Accordingly, the reliability can be increased through the improvement in operation efficiency and the prevention of overheating of the compressor.

The above and other objects, features and advantages of the invention will become clear from the following description of the preferred embodiments taken in conjunction with the accompanying drawings.

DETAILED DESCRIPTION

Preferred embodiments of the invention will be described hereinunder with reference to the accompanying drawings.

Figure 1:
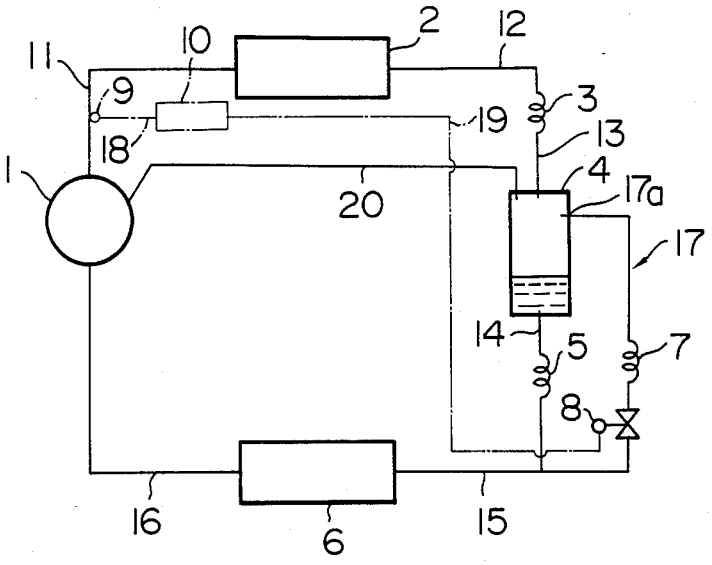
FIG. 1 is schematic view of a refrigerant circuit of a refrigerating apparatus in accordance with one embodiment of the invention.

Referring now to the drawings wherein like reference numerals are used throughout the various views to designate like parts and, more particularly, to FIG. 1, according to this figure, a refrigerating apparatus includes a compressor 1, a condenser 2, a first expansion device 3, a gas-liquid separator 4, a second expansion device 5 and an evaporator 6 are successively connected through pipings 11, 12, 13, 14, 15 and 16 to form a main refrigerant circuit. An injection path 20 is connected to the gas-phase position in the upper part of the gas-liquid separator 4. The other end of the injection path 20 is connected and opened to a cylinder (not shown) of the compressor 1 during the compression stroke. In addition, an auxiliary path generally designated by the reference numeral 17, constituted by an auxiliary expansion device 7 and a solenoid valve 8 which are connected in series through piping, is provided between a position in the upper part of the gas-liquid separator 4 and the evaporator 6, with the auxiliary expansion device 7 being disposed in parallel to the second expansion device 5. The discharge piping 11 of the compressor 1 is provided with a pressure detection unit 9, which detects the discharge pressure and converts the same into an electric signal or the like and then delivers the same to a control unit 10 through an electric wire 18. The control unit 10, in response to the signal from the pressure detection unit 9, energizes or deenergizes the solenoid valve 8 through an electric wire 19 to control the ON/OFF operation of the solenoid valve 8.

In the above refrigerant circuit, the solenoid valve 8 is closed in the normal operation. The refrigerant gas discharged from the compressor 1 is cooled and condensed to liquefy in the condenser 2 and is then passed through the first expansion device 3, where it is reduced to an intermediate pressure, to allow a part of the refrigerant to gasify. Then, the refrigerant flows into the gas-liquid separator 4, where the refrigerant is separated into a gas portion and a liquid portion. The liquid refrigerant passes through the second expansion device 5, where it is reduced to a predetermined pressure and flows into the evaporator 6. In the evaporator 6, the liquid refrigerant absorbs heat through the heat exchange with a heat-exchange fluid (air or water) to evaporate and then returns to the compressor 1. On the other hand, the gas refrigerant separated in the gas-liquid separator 4 is passed through the injection path 20 and injected into the compressor 1 during the compression stroke thereof. Under such a normal operation as mentioned above, the amount of refrigerant charged in the gas-liquid separator 4 is set so that the level of the liquid refrigerant therein is relatively low.

When the load on the condenser 2 or the evaporator 6 increases, the discharge pressure rises. Therefore, the discharge pressure is detected by the pressure detection unit 9. If the discharge pressure rises to a set pressure, the detection signal is led to the control unit 10, through which an electric power is supplied to the solenoid valve 8 to open the same. Consequently, the gas-phase part of the gas-liquid separator 4 and the evaporator 6 are allowed to communicate with each other through the auxiliary expansion device 7. Accordingly, the difference in pressure between the gas-phase part and the evaporator 6 decreases to reduce the amount of the liquid refrigerant flowing out from the gas-liquid separator 4. As a result, the level of the liquid refrigerant in the gas-liquid separator 4 gradually rises, i.e., the liquid refrigerant stored therein increases in amount, resulting in a reduction in amount of the refrigerant circulating through the refrigerant circuit. Consequently, the refrigerant collected in the condenser 2 decreases in amount to lower the refrigerant supercooling degree at the outlet of the condenser 2. Moreover, since the pressure in the gas-liquid separator 4 lowers, the gas refrigerant to be injected into the compressor 1 also decreases in flow rate. Accordingly, the refrigerant gas discharged from the compressor 1 also decreases in flow rate. Thus, even if the load on the condenser 2 or the evaporator 6 increases, the rise in discharge pressure is reduced. In addition, the rise in discharge temperature, the rise in input of the compressor and so forth can be held down to a small degree.

Figure 2:
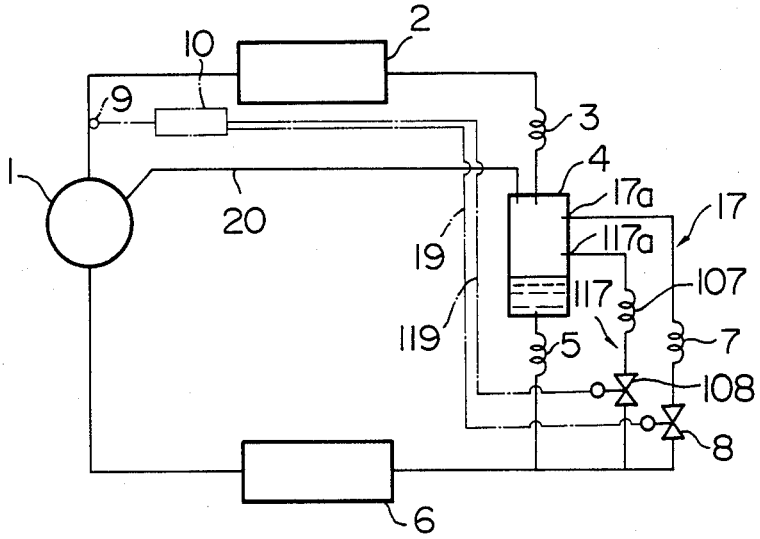
FIG. 2 is a schematic view of a refrigerant circuit of a refrigerating apparatus in accordance with another embodiment of the invention.

The embodiment of FIG. 2 differs from the embodiment shown in FIG. 1 in that the embodiment shown in FIG. 2 has two parallel auxiliary paths provided between the gas-liquid separator 4 and the evaporator 6. More specifically, between an upper part portion of the gas-liquid separator 4 and the evaporator 6, a first auxiliary path 117 constituted by a first auxiliary expansion device 107 and a first solenoid valve 108, connected in series through piping, is connected in parallel to the auxiliary path 17, hereinafter referred to as a second auxiliary path, constituted by the auxiliary expansion device 7, hereinafter referred to as a second auxiliary expansion device, and the solenoid valve 8, hereinafter referred to as a second solenoid valve, connected in series through piping. The connecting position 117*a* of the first auxiliary path 117 to the gas-liquid separator 4 is lower than the connecting position 17*a* of the second auxiliary path 17 to the gas-liquid separator 4. The ON/OFF operation of the first solenoid valve 108 is also controlled by the control unit 10 through an electric wire 119. The operation of the refrigerating apparatus of FIG. 2, in the normal load condition, is the same as that of the embodiment shown in FIG. 1; hence, the description thereof is omitted.

When the load on the condenser 2 or the evaporator 6 increases, the discharge pressure rises. The rise in pressure is detected by the pressure detection unit 9. If the discharge pressure rises to a first set pressure, a signal corresponding to the detected pressure is sent to the control unit 10, through which the first solenoid valve 108 is opened. As a result, the level of the liquid refrigerant in the gas-liquid separator 4 rises to the height of the connecting position 117*a* of the first auxiliary path 117, i.e., the liquid refrigerant stored in the gas-liquid separator 4 increases in amount. Consequently, the refrigerant circulating through the refrigerant circuit decreases in amount to hold down the rise in discharge pressure. During the operation under such a state, if the load further increases to raise the discharge pressure to the first set pressure again or to a second set pressure, which is higher than the first set pressure, the rise in pressure is detected by the pressure detection unit 9. The detection signal is sent to the control unit 10, through which the second solenoid valve 8 is opened and, at the same time, the first solenoid valve 108 is closed. Consequently, the level of the liquid refrigerant in the gas-liquid separator 4 further rises until the liquid refrigerant is collected to the height of the connecting position 17*a* of the second auxiliary path 17. Accordingly, the refrigerant circulating through the refrigerant circuit further decreases in amount to hold down the rise in discharge pressure furthermore, resulting in a reduction in discharge pressure.

Thus, it is possible to effect a proper operation control according to the load condition through the checking of the rise in discharge pressure in two stages by providing two auxiliary paths 17, 117 different in height of the connecting positions thereof to the gas-liquid separator 4 and changing over the solenoid valve to be opened from one to the other according to the rise in discharge pressure.

Figure 3:
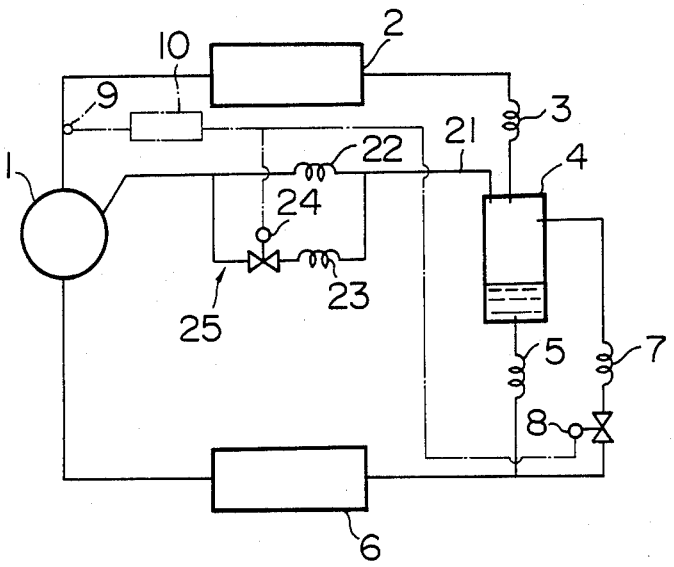
FIG. 3 is a schematic view of a refrigerant circuit of a refrigerating apparatus in accordance with still another embodiment of the invention.

The embodiment of FIG. 3 differs from the embodiment shown in FIG. 1 in that the embodiment shown in FIG. 3 has an injection path 21.

In FIG. 3, a flow path resistance member 22, for regulating the flow rate, is inserted in an intermediate portion of the injection path 21. In addition, a path 25 constituted by an auxiliary flow path resistance member 23 and a solenoid valve 24 for injection which are connected in series is connected in parallel to the resistance member 22 through piping. The flow path resistance member 23 is formed to have a small fluid resistance, while the flow path resistance member 22 is formed to have a large fluid resistance. Moreover, the ON/OFF operation of the solenoid valve 24 for injection, together with the solenoid valve 8 for the separator, is controlled through the control unit 10 according to the discharge pressure detected by the pressure detection unit 9. The solenoid valve 24 is controlled so as to be open during the normal operation and closed when the discharge pressure rises. In the normal load condition, the operation of the refrigerating apparatus having the above construction is similar to that of the apparatus shown in FIG. 1, except that the gas refrigerant to be injected into the compressor 1 through the injection path 21 flows through the flow path resistance member 22 and the auxiliary flow path resistance member 23 in parallel.

When the load on the condenser 2 or the evaporator 6 increases, a rise in discharge pressure is detected by the pressure detection unit 9 in the same manner as that in the apparatus shown in FIG. 1, and the solenoid valve 8 for the separator is opened through the control unit 10. As a result, the level of the liquid refrigerant in the gas-liquid separator 4 rises, and the refrigerant circulating through the refrigerant circuit decreases in amount. In addition, the gas refrigerant flowing into the injection path decreases in flow rate with the lowering of the pressure in the gas-liquid separator 4. Moreover, in the embodiment of FIG. 3, the solenoid valve 24 for injection is closed according to the detected discharge pressure. Consequently, the gas refrigerant to be injected flows through only the flow path resistance member 22, so that the resistance to flow increases to further decrease the flow rate of the gas refrigerant to be injected. Accordingly, the rise in discharge pressure is smaller.

It is to be noted that although in all the above-described embodiments, each solenoid valve is controlled through the detection of the load condition by detecting the discharge pressure by the pressure detection unit 9 provided on the discharge piping, it is also possible for the pressure detection unit 9 to be replaced with a temperature detection unit which is thermally conductibly provided on the discharge piping to detect the discharge temperature for sensing the load condition, and the detected temperature is introduced to the control unit 10 as a signal to control the ON/OFF operation of each solenoid valve.

Although the invention has been described through specific terms, it is to be noted here that the described embodiments are not exclusive and various changes and modifications may be imparted thereto without departing from the scope of the invention which is limited solely by the appended claims.

What is claimed is:

1. A refrigerating apparatus comprising:

a main refrigerant circuit including a compressor, a condenser, a first expansion device, a gas-liquid separator, a second expansion device and an evaporator which are successively connected through piping;

an injection path for interconnecting an upper part of said gas-liquid separator and a cylinder of said compressor during a compression stroke thereof;

at least one auxiliary path formed by connecting a solenoid valve closed in a normal operation and an auxiliary expansion device, said auxiliary path being provided between said gas-liquid separator and evaporator so as to be in parallel to said second expansion device, said auxiliary path being connected to said gas-liquid separator at a position higher than a connecting position of said second expansion device to said gas-liquid separator;

means for detecting a load on the refrigerating apparatus; and means for controlling an operation of the solenoid valve in response to a detection of the load on the refrigerating apparatus whereby said solenoid valve is opened when the load on said refrigerating apparatus increases.

2. A refrigerating apparatus according to claim 1, wherein said auxiliary path includes two parallel auxiliary paths, each of said auxiliary paths being formed by connecting a solenoid valve and an auxiliary expansion device between said gas-liquid separator and evaporator so that said auxiliary paths are connected to said gas-liquid separator at respective positions different in height from each other, and wherein as the load on said refrigerating apparatus increases, the solenoid valve to be opened is successively changed over from the solenoid valve of said auxiliary path connected to said gas-liquid separator at a position lower than that of the other to the solenoid valve of said auxiliary path connected to said gas liquid separator at a higher position.

3. A refrigerating apparatus according to one of claims 1 or 2, further comprising:

a main flow path resistance member provided in said injection path; and a path constituted by connecting an injection solenoid valve which is open during the normal operation and an auxiliary flow path resistance member, said path being connected in parallel to said main flow path resistance member, and wherein said injection solenoid valve is closed when the load on said refrigerating apparatus increases.

4. A refrigerating apparatus according to claim 3, wherein said means for detecting includes a pressure detection unit provided on a discharge piping of said compressor, and wherein a detection signal from said pressure detection unit is supplied to said controlling means so as to energize or deenergize each of said solenoid valves to control an ON/OFF operation of each solenoid valve according to a rise in discharge pressure.

5. A refrigerating apparatus according to claim 3, wherein said means for detecting include a temperature detection unit thermally conductibly provided on a discharge piping of said compressor, and wherein a detection signal from said temperature detection unit is led to said controlling means so as to energize or deenergize each of said solenoid valves to control an ON/OFF operation of each solenoid valve according to a rise in discharge temperature.

6. A refrigerating apparatus according to claim 3, wherein said main flow path resistance member has a large flow path resistance, and wherein said auxiliary flow path resistance member has a small flow path resistance.

7. A refrigerating apparatus according to claim 2, wherein said means for detecting includes a pressure detection unit provided on a discharge piping of said compressor, and wherein a detection signal from said pressure unit is supplied to said controlling means so as to energize or deenergize each of said solenoid valves to control an ON/OFF operation of each solenoid valve according to a rise in discharge pressure.

8. A refrigerating apparatus according to claim 2, wherein said means for detecting includes a temperature detection unit thermally conductibly provided on a discharge piping of said compressor, and wherein a detection signal from said temperature detection unit is supplied to said controlling means so as to energize or deenergize each of said solenoid valves to control an ON/OFF operation of each solenoid valve according to a rise in discharge temperature.

9. A refrigerating apparatus comprising:

a main refrigerant circuit including a compressor, a condenser, a first expansion device, a gas-liquid separator, a second expansion device, and an evaporator which are successively connected through piping;

an injection path for interconnecting an upper part of said gas-liquid separator and a cylinder of said compressor during a compression stroke thereof;

an auxiliary path formed by connecting a solenoid valve closed in a normal operation and an auxiliary expansion device, said auxiliary path being provided between said gas-liquid separator and evaporator so as to be in parallel to said second expansion device, said auxiliary path being connected to said gas-liquid separator at a position higher than a connection position of said second expansion device to said gas-liquid separator and a pressure detecting unit provided on a discharge piping of said compressor, and wherein a pressure detecting signal from said pressure detection unit is led to a control unit, which energizes or deenergizes said solenoid valve to control the ON/OFF operation of said solenoid valve according to a rise in discharge pressure.

10. A refrigerating apparatus comprising:

a main refrigerant circuit including a compressor, a condenser, a first expansion device, a gas-liquid separator, a second expansion device and an evaporator which are successively connected through piping;

an injection path for interconnecting an upper part of said gas-liquid separator and a cylinder of said compressor during a compression stroke thereof;

an auxiliary path formed by connecting a solenoid valve closed in a normal operation and an auxiliary expansion device, said auxiliary path being provided between said gas-liquid separator and evaporator so as to be in parallel to said second expansion device, said auxiliary path being connected to said gas-liquid separator at a position higher than a connecting position of said second expansion device to said gas-liquid separator; and a temperature detection unit thermally conductibly provided on a discharge piping of said compressor, and wherein a detection signal from said temperature detection unit is led to a control unit, which energizes or deenergizes said solenoid valve to control the ON/OFF operation of said solenoid valve according to a rise in discharge temperature.

* * * * *